US005119771A

United States Patent [19]

Davis et al.

[11] Patent Number: 5,119,771

[45] Date of Patent: Jun. 9, 1992

[54] VERTICAL THREE CYLINDER TWO CYCLE ENGINE WITH SINGLE CARBURETOR AND MANIFOLD COMBINATION

[75] Inventors: Richard A. Davis, Mequon; George E. Phillips, Oshkosh, both of Wis.

[73] Assignee: Brunswick Corporation, Skokie, Ill.

[21] Appl. No.: 737,161

[22] Filed: Jul. 29, 1991

Related U.S. Application Data

[63] Continuation-in-part of Ser. No. 707,706, May 30, 1991.

[51] Int. Cl.[5] ..... F02M 35/10

[52] U.S. Cl. ..... 123/73 A

[58] Field of Search ..... 123/52 M, 52 MC, 65 R, 123/73 A, 73 B, 73 C

[56] References Cited

U.S. PATENT DOCUMENTS

| | | | |
|---|---|---|---|
| 1,818,283 | 8/1931 | Spencer | 123/65 R |
| 2,773,489 | 12/1956 | Estes | 123/73 A |
| 3,060,914 | 10/1962 | Morand | 123/65 R |
| 3,592,173 | 7/1971 | Frehe | 123/73 A |
| 4,181,101 | 1/1980 | Yamamoto | 123/73 A |
| 4,227,492 | 10/1980 | Haase | 123/52 M |
| 4,345,551 | 8/1982 | Bloemers | 123/52 M |
| 4,711,201 | 12/1987 | Ooyama et al. | 123/73 A |
| 4,777,913 | 10/1988 | Staerzl et al. | 123/73 A |
| 4,905,638 | 3/1990 | Curtis et al. | 123/73 A |
| 5,005,535 | 4/1991 | Binversle et al. | 123/73 A |

OTHER PUBLICATIONS

"A Five-Cylinder Outboard Engine", Richard A. Davis, SAE Technical Paper Series, 891751, Small Engine Technology Conf. Milwaukee, WI, Sep. 11-13, 1989.

*Primary Examiner*—David A. Okonsky

*Attorney, Agent, or Firm*—Andrus, Sceales, Starke & Sawall

[57] ABSTRACT

In a two cycle internal combustion engine having three cylinders vertically in-line, a single intake manifold (210) services all three of the cylinders, and a single fuel delivery device on the manifold has a throttle bore (128*a*) at the uppermost reed block opening (204) and spaced above the other reed block openings (206, 208). The bottotm (220) of the throttle bore is spaced slightly above the bottom (222) of the uppermost reed block opening. A flow divider dam (228) in the manifold is below the uppermost reed block opening and a first portion (216) of the throttle bore, and divides the flow from the throttle bore and diverts to the upper cylinder a portion of the gravitationally induced vertical fuel flow which would otherwise drain to the lower cylinder during engine idle.

19 Claims, 8 Drawing Sheets

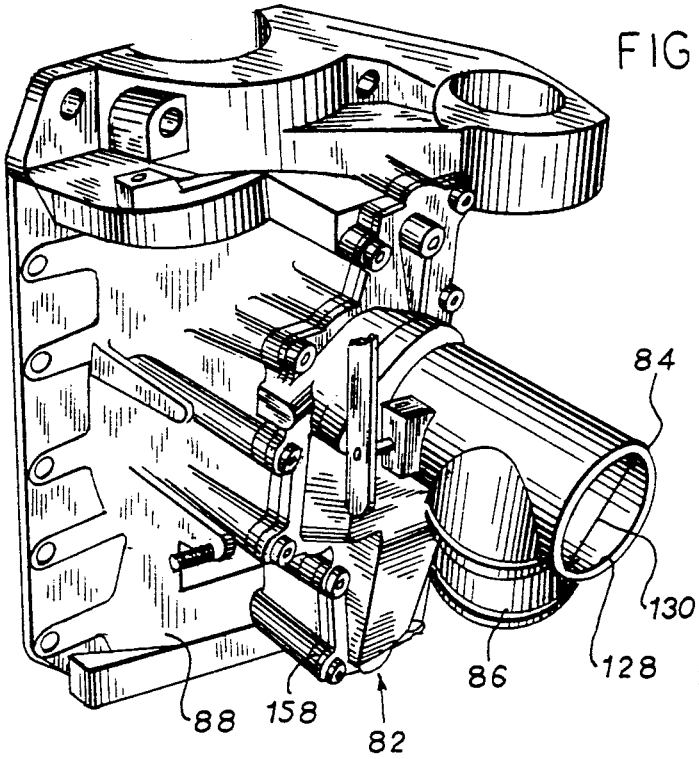
FIG. 5
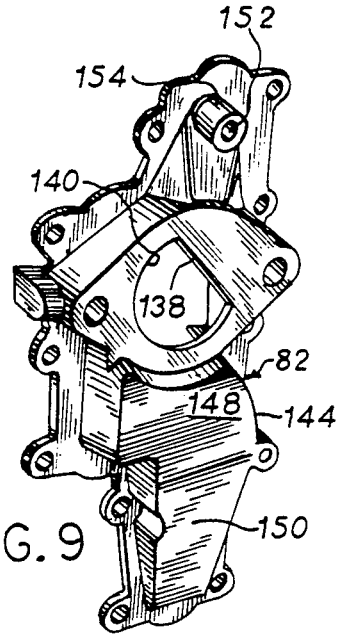
FIG. 9
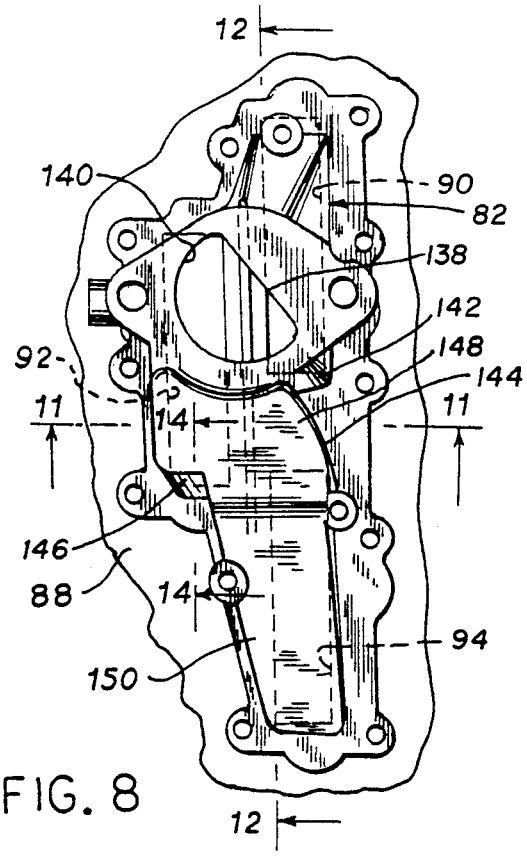
FIG. 8
FIG. 10
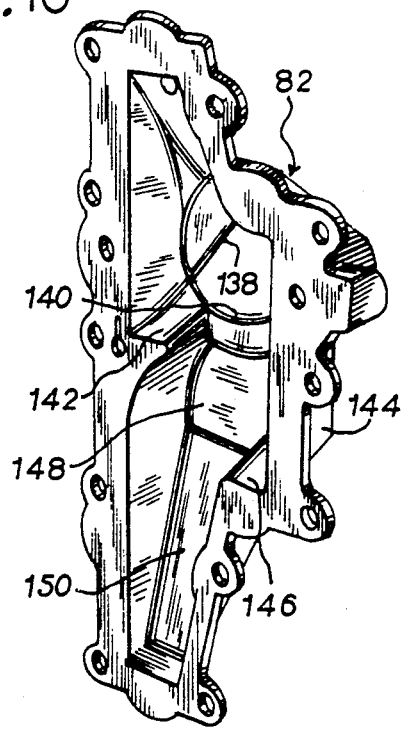

FIG. 15
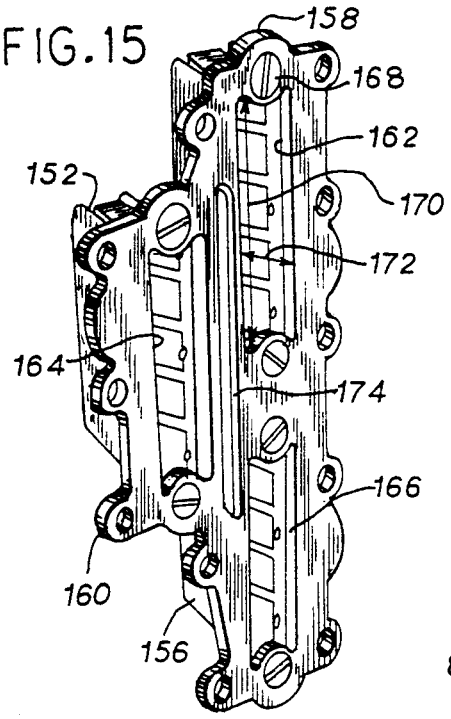
FIG. 6
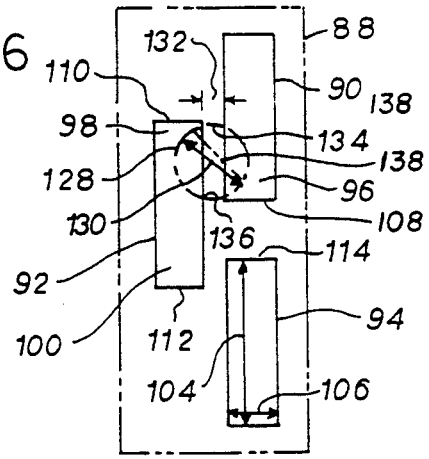
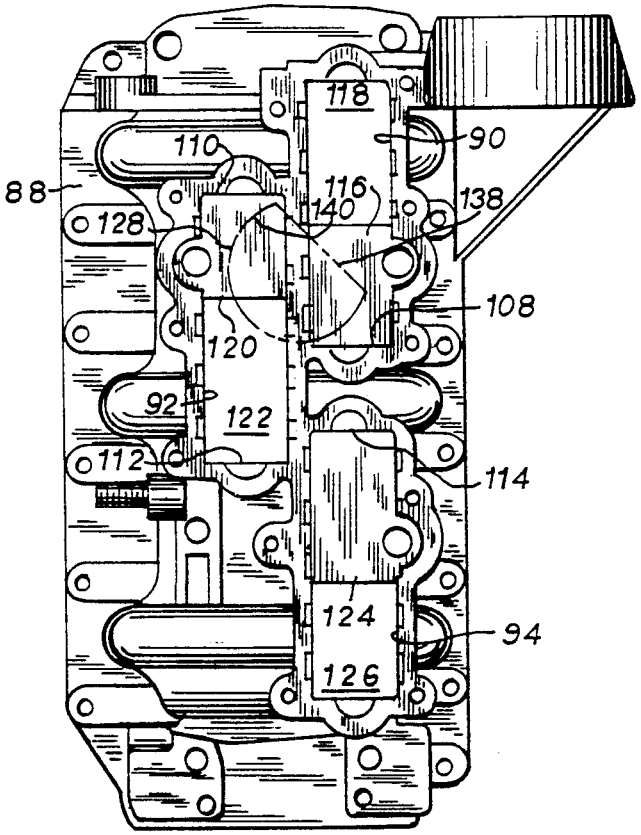
FIG. 7
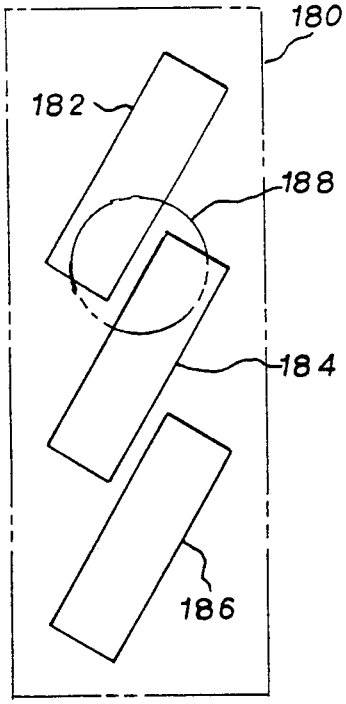
FIG. 16

FIG. 20
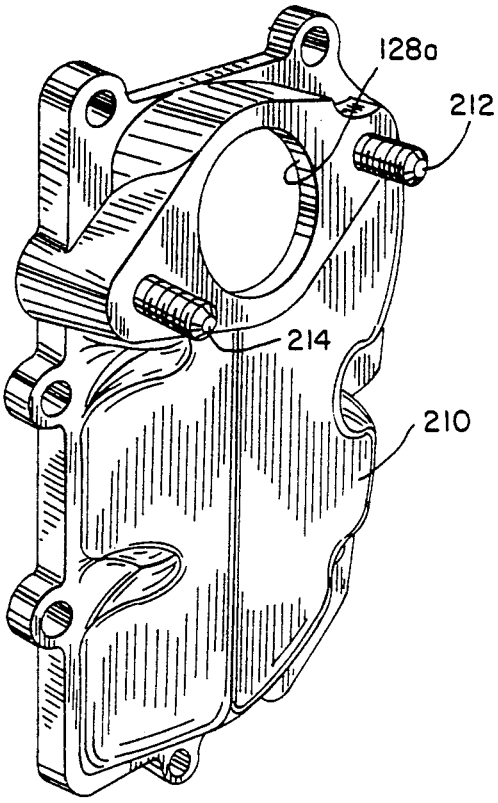
FIG. 21
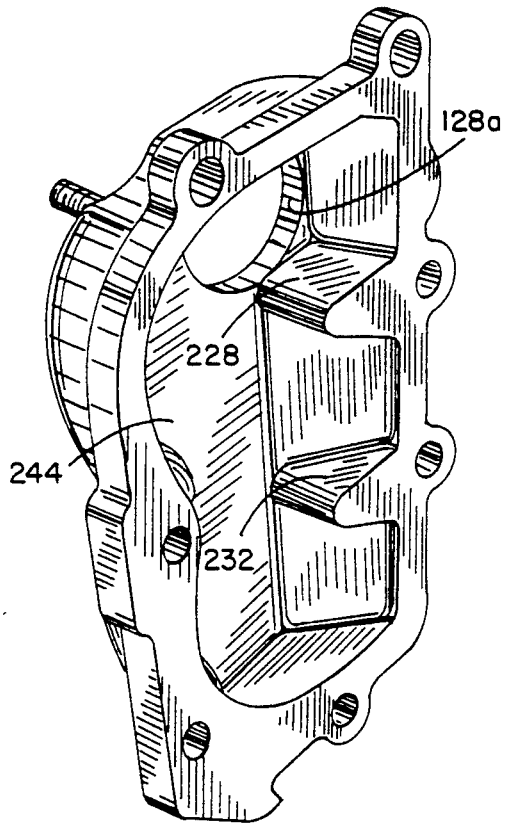
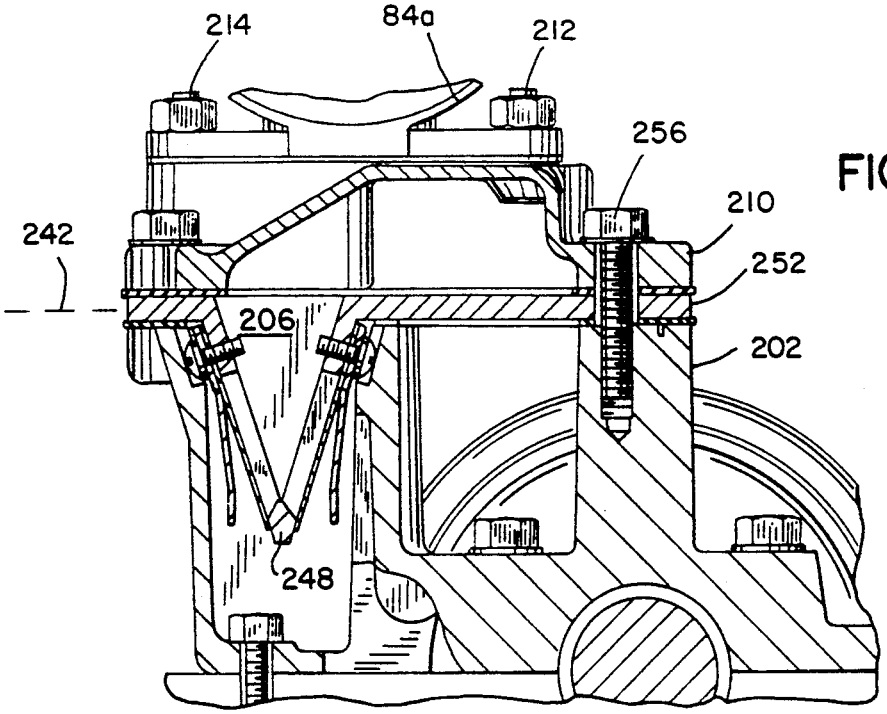
FIG. 22

FIG. 23
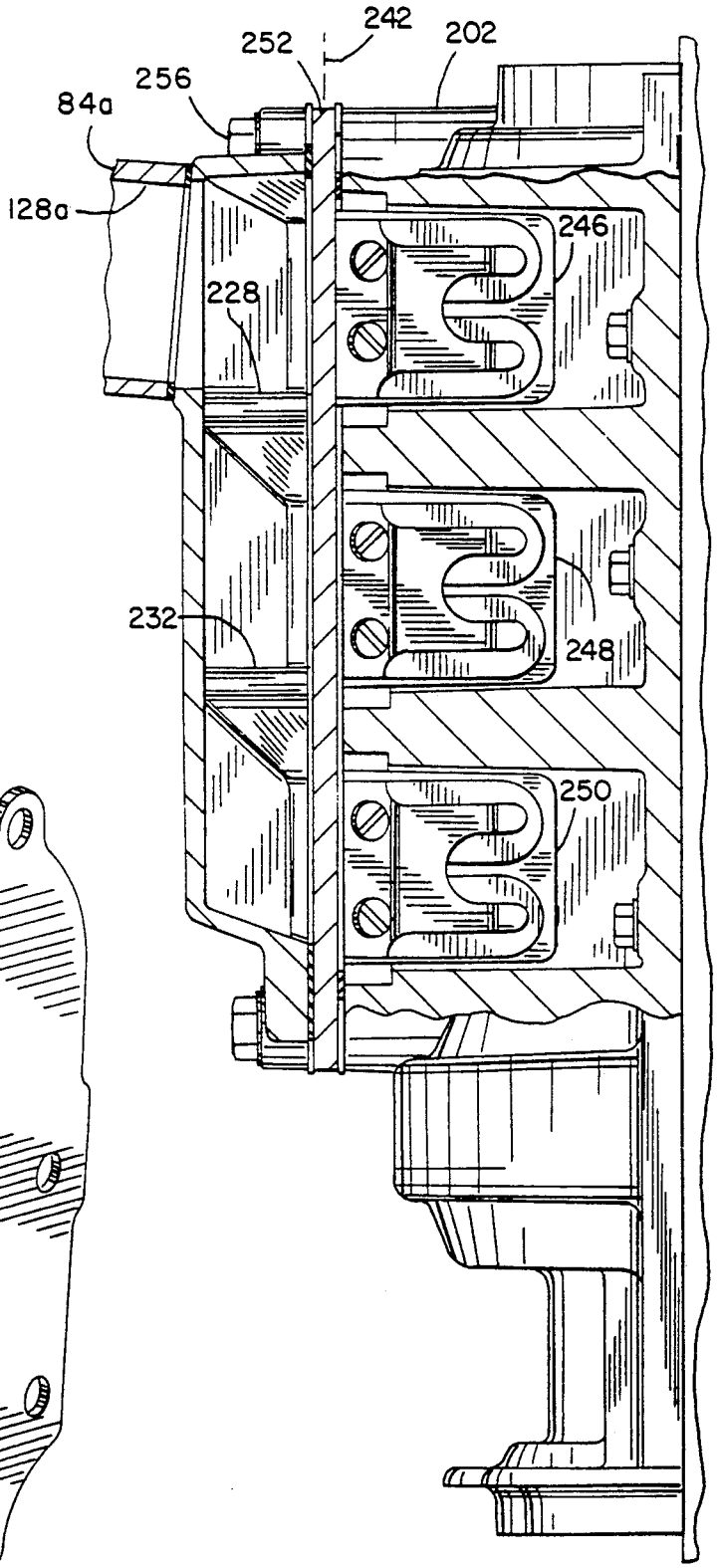
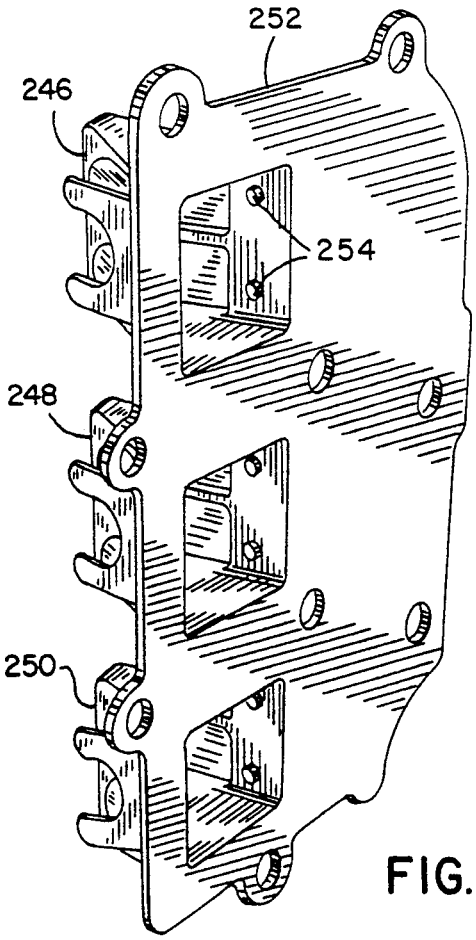
FIG. 24

VERTICAL THREE CYLINDER TWO CYCLE ENGINE WITH SINGLE CARBURETOR AND MANIFOLD COMBINATION

CROSS REFERENCE TO RELATED

This application is a continuation in part of application Ser. No. 07/707,706, filed May 30, 1991.

BACKGROUND AND SUMMARY

The invention relates to two cycle internal combustion engines with vertically in-line cylinders, and more particularly to simple and significantly cost-reduced fuel delivery structure therefor.

The invention arose during continuing development efforts directed toward two cycle internal combustion marine engines having three cylinders vertically inline. In the prior art, each cylinder has its own carburetor which supplies fuel through a respective reed block into the crankcase. The carburetor throttles are connected to each other by throttle linkage. This system is costly because of the expense of three separate carburetors. Furthermore, tuning requires not only synchronization of all three carburetors through the linkage, but also three sets of adjustments, e.g. three separate idle mixture adjustment screws, three choke linkages, etc.

The invention provides a simple and effective solution to the above noted problems, and provides a significant cost reduction. A single intake manifold services all three cylinders, and a single fuel delivery device on the manifold delivers fuel to all of the cylinders. The invention eliminates the extra carburetors, the complicated linkage system, the extra adjustments, etc.

BRIEF DESCRIPTION OF THE DRAWINGS

Prior Art

Parent Application

Figure 1:
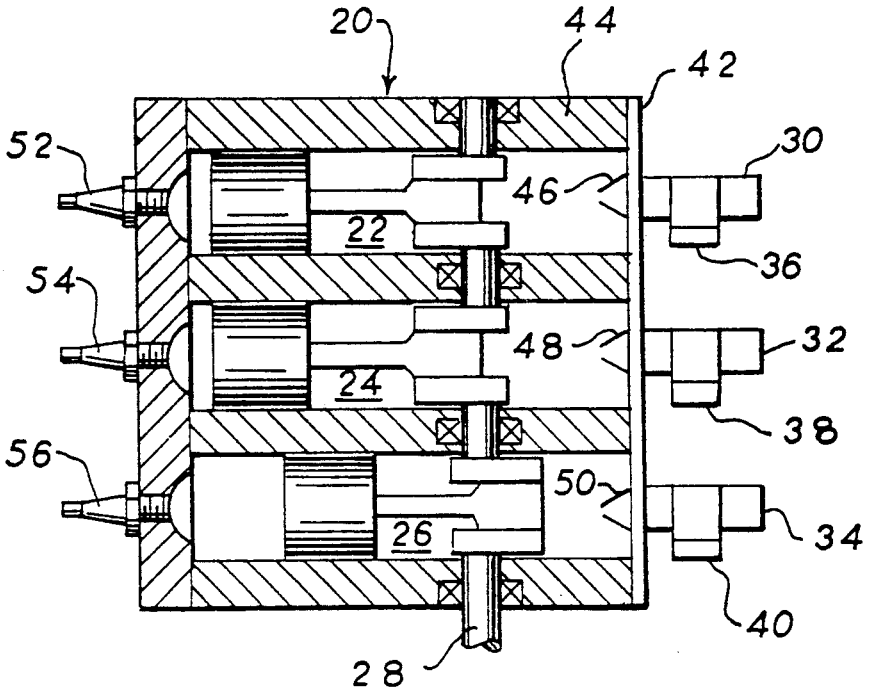
FIG. 1 PRIOR ART
FIG. 1 is a schematic illustration of a two cycle internal combustion engine with three cylinders vertically in-line, as known in the prior art.
Figure 4:
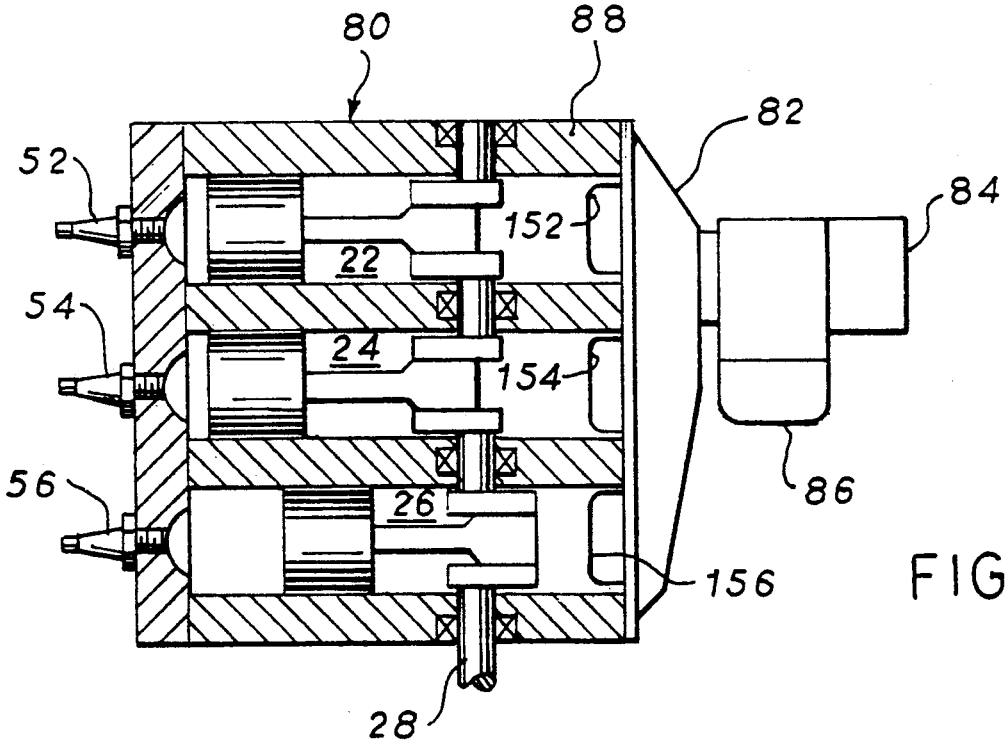

FIG. 4 is a view like FIG. 1 and illustrates the invention of the noted parent application.

FIG. 5 is a perspective view with some further detail of a portion of the structure of FIG. 4.

FIG. 6 is a schematic view looking into the crankcase of FIG. 5 and illustrates the invention of the noted parent application.

Figure 3:
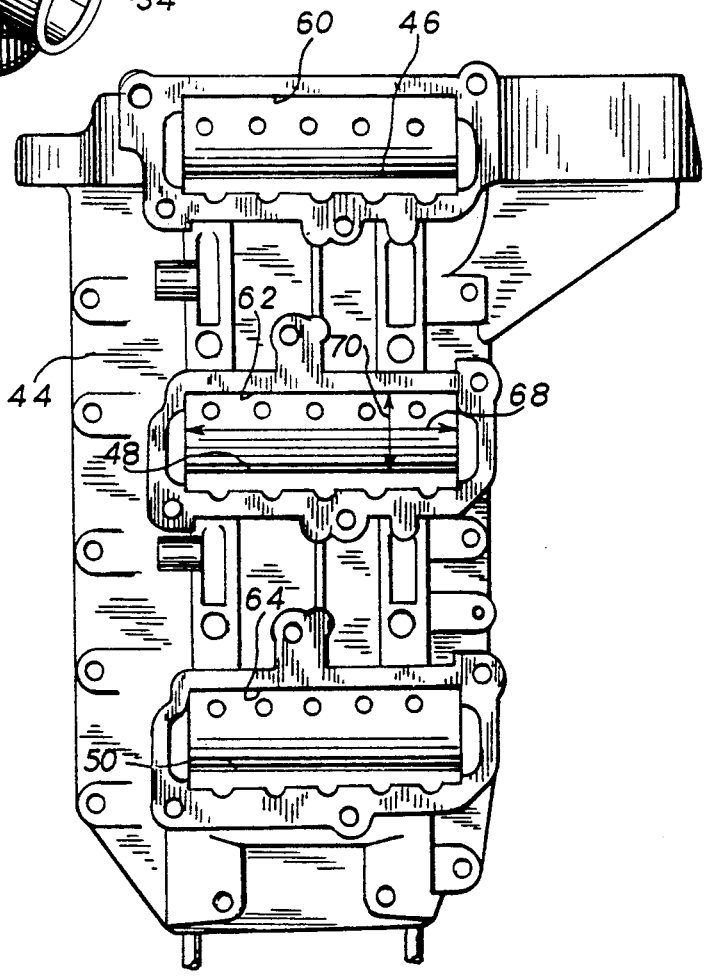
FIG. 3 PRIOR ART
FIG. 3 is a side plan view looking into the crankcase of FIG. 2.

FIG. 7 is like FIG. 3 and shows the invention of the noted parent application.

FIG. 8 is a side plan view of a portion of the structure of FIG. 5.

FIG. 9 is a perspective view of the manifold of FIG. 5.

FIG. 10 is a perspective view of the reverse side of the manifold of FIG. 9.

Figure 11:
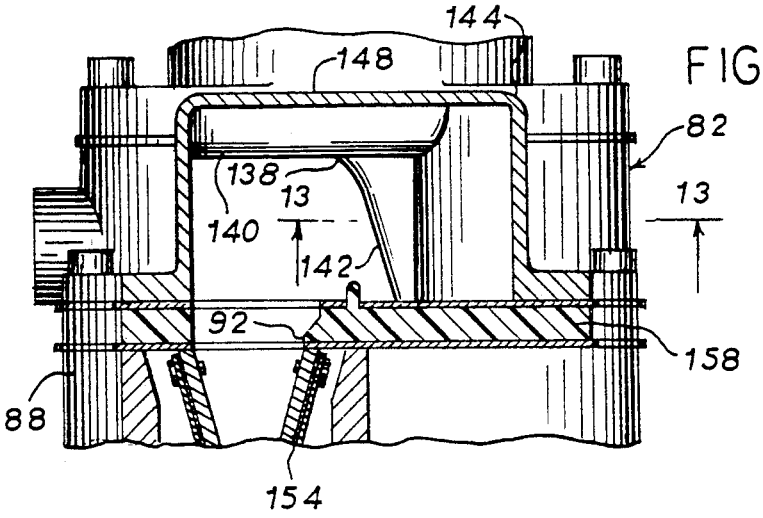

FIG. 11 is a sectional view taken along line 11—11 of FIG. 8.

Figure 12:
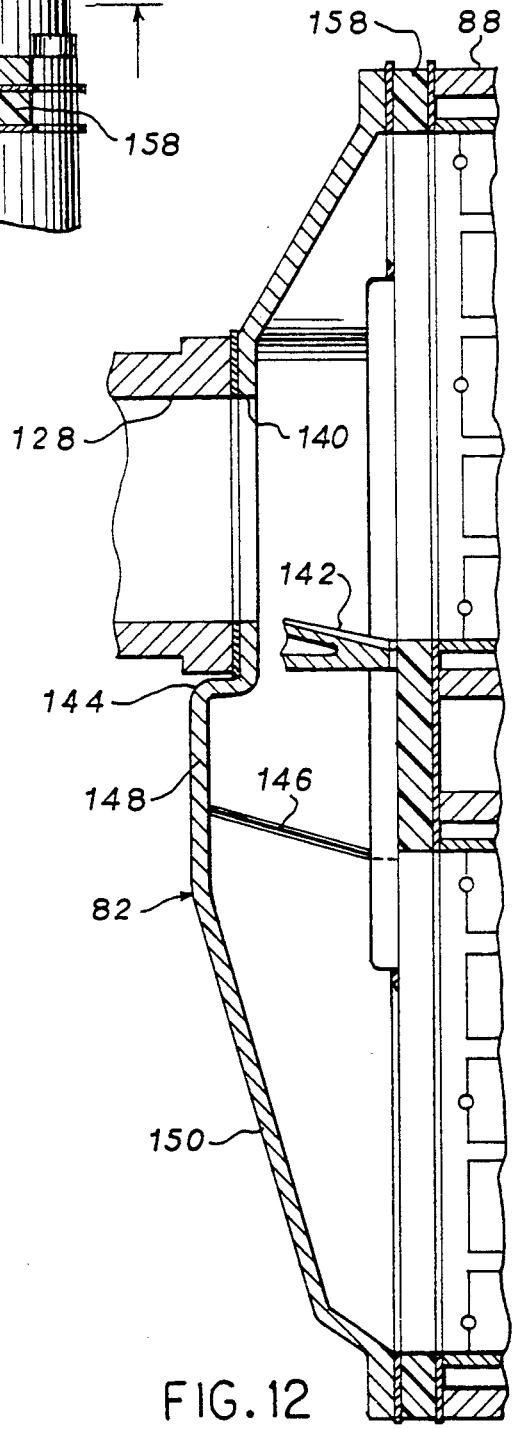

FIG. 12 is a sectional view taken along line 12—12 of FIG. 8.

Figure 13:
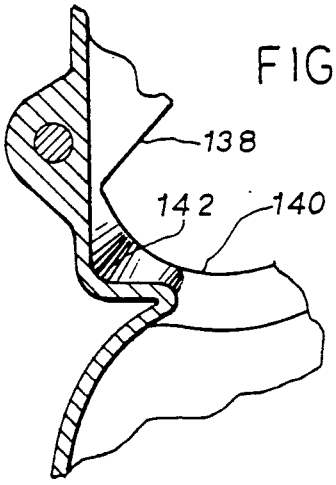

FIG. 13 is a sectional view taken along line 13—13 of FIG. 11.

Figure 14:
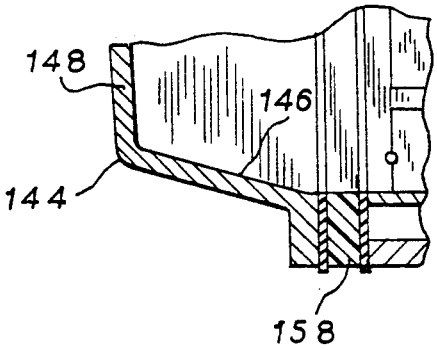

FIG. 14 is a sectional view taken along line 14–14 of FIG. 8.

FIG. 15 is a perspective view of the reed blocks and reed block adaptor of FIG. 5.

FIG. 16 is like FIG. 6 and shows an alternate embodiment.

Present Invention

Figure 17:
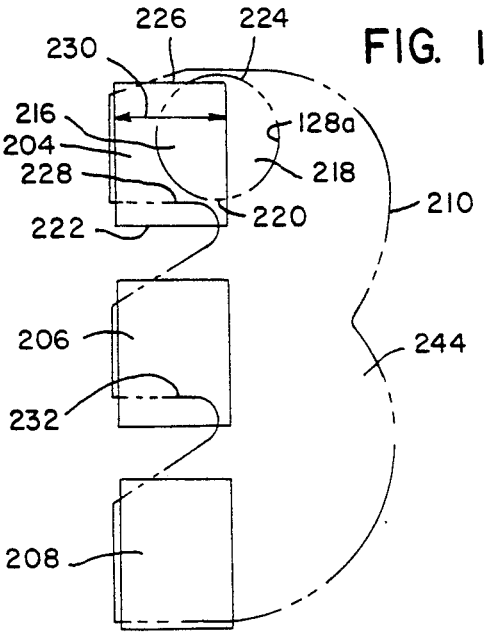

FIG. 17 is a view like FIG. 6 and illustrates the present invention.

Figure 18:
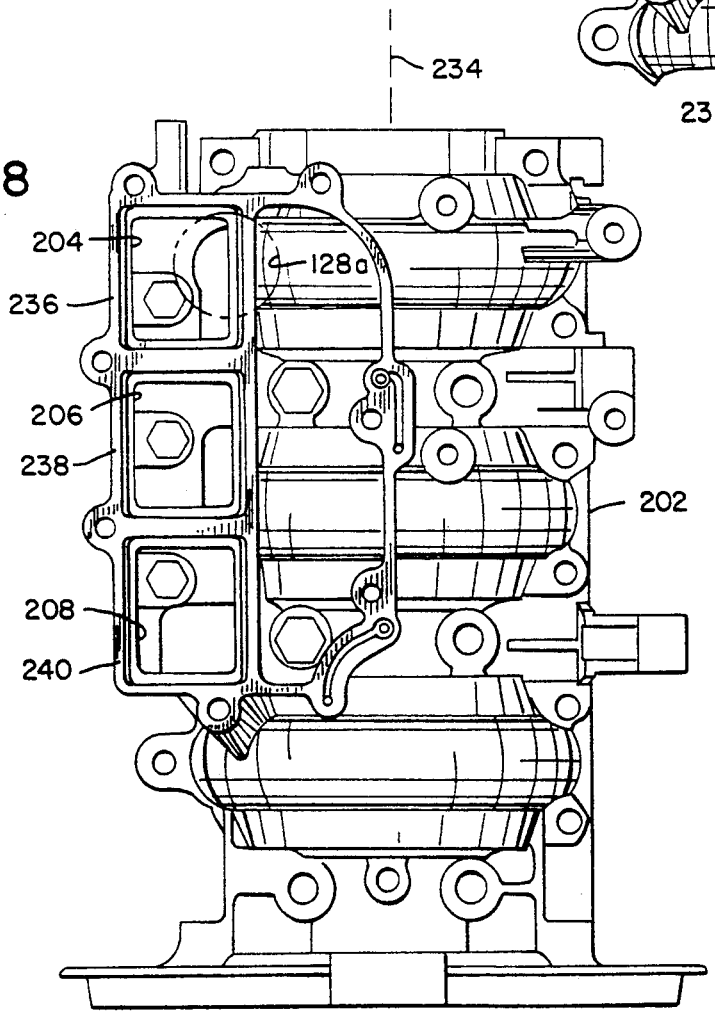

FIG. 18 is a view like FIG. 7 and shows the present invention.

Figure 19:
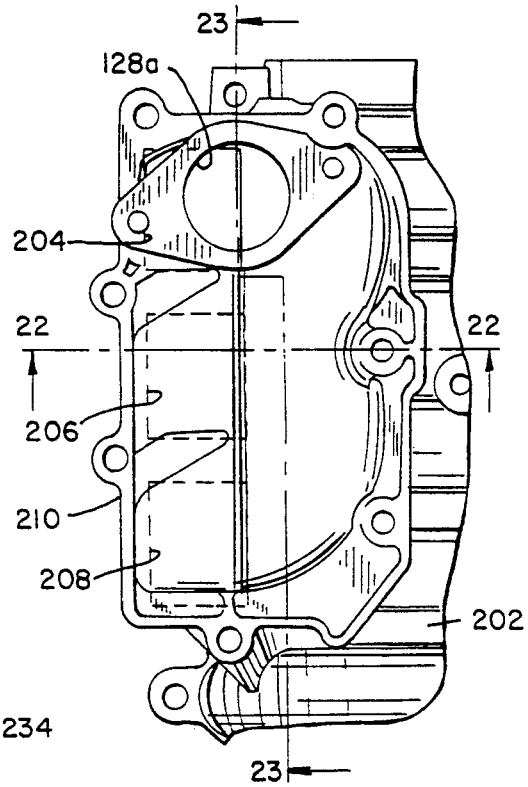

FIG. 19 is like FIG. 8 and shows the present invention.

FIG. 20 is a perspective view of the manifold of FIG. 19.

FIG. 21 is a perspective view of the reverse side of the manifold of FIG. 20.

FIG. 22 is a sectional view taken along line 22—22 of FIG. 19.

FIG. 23 is a sectional view taken along line 23—23 of FIG. 19.

FIG. 24 is like FIG. 15 and shows the present invention.

DETAILED DESCRIPTION

Prior Art

Figure 2:
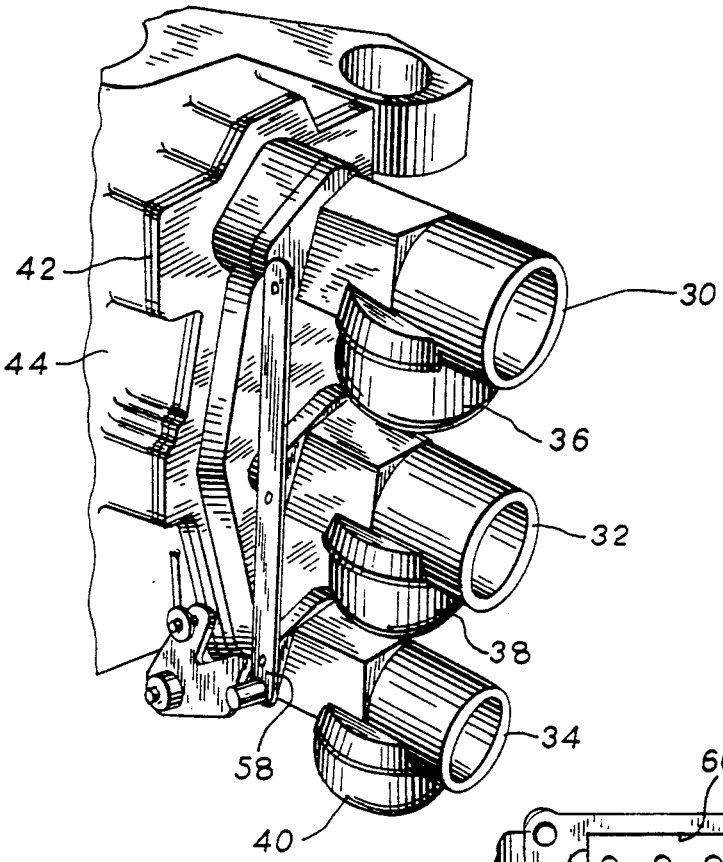
FIG. 2 PRIOR ART
FIG. 2 is a perspective view with some further detail of a portion of the structure of FIG. 1.

FIG. 1 schematically shows a two cycle internal combustion engine 20 having three cylinders 22, 24, 26, vertically in-line and drivingly rotating a vertical crankshaft 28. Each cylinder has its own carburetor 30, 32, 34, respectively, each with a float bowl 36, 38, 40, respectively, as further shown in FIG. 2. The carburetors are mounted to a reed plate adaptor 42 which is mounted to the engine crankcase 44. Three reed blocks 46, 48, 50, one for each cylinder, are mounted to adaptor 42 and extend into the respective cylinder 22, 24. 26, to admit a combustible fuel mixture which flows through respective transfer passages (not shown) to the other end of the respective cylinder for ignition by the respective spark plug 52, 54, 56. The carburetor throttles are connected to each other by throttle linkage 58, FIG. 2. Reed blocks 46, 48, 50 are received in respective reed block openings 60, 62, 64, FIG. 3, in crankcase 44. Each of the reed block openings has a length, as shown at arrow 68, and a width as shown at arrow 70. Length 68 is greater than width 70. Each of the reed block openings extends longitudinally horizontally along the dimension of length 68.

Parent Application

FIG. 4 schematically shows a two cycle internal combustion engine 80 in accordance with the parent application and uses like reference numerals from FIG. 1 where appropriate to facilitate understanding. The engine has three cylinders 22, 24, 26 vertically in-line, a single manifold 82 servicing all three of the cylinders, and a single fuel delivery device 84 on the manifold delivering fuel to each of the cylinders. Fuel delivery device 84 is a carburetor having a float bowl 86, FIG. 5, or may alternatively be a throttle body fuel injection device, or the like.

Engine crankcase 88, FIGS. 6 and 7, has first, second and third reed block openings 90, 92, 94, one for each of respective cylinders 22, 24, 26. Manifold 82 covers all of the reed block openings 90, 92, 94, FIG. 8. Reed block opening 90 has a portion 96, FIG. 6, horizontally aligned with a portion 98 of reed block opening 92. Reed block opening 92 has another portion 100 horizontally aligned with a portion 102 of reed block opening 94. Reed block openings 90 and 94 are vertically aligned. Reed block opening 92 is horizontally offset from reed block openings 90 and 94.

Each of the reed block openings has a length, as shown at arrow 104, FIG. 6, and a width, as shown at arrow 106. Length 104 is greater than width 106. Each of the reed block openings extends longitudinally vertically along length 104 between a top end and a bottom end. The bottom end 108 of reed block opening 90 is lower than the top end 110 of reed block opening 92. The bottom end 112 of reed block opening 92 is lower than the top end 114 of reed block opening 94. The longitudinal extent of reed block opening 92 is parallel to the longitudinal extent of reed block opening 90 and parallel to the longitudinal extent of reed block opening 94. The longitudinal extents of reed block openings 90 and 94 are colinear. Reed block opening 90 includes a ramp 116, FIG. 7, within crankcase 88 directing the fuel mixture upwardly towards the center 118 of cylinder 22. Reed block opening 92 includes a ramp 120 within crankcase 88 directing the fuel mixture downwardly towards the center 122 of cylinder 24. Reed block opening 94 includes a ramp 124 within crankcase 88 directing the fuel mixture downwardly towards the center 126 of cylinder 26.

Fuel delivery device 84 has a throttle bore 128, FIG. 5, horizontally aligned with portions 96 and 98, FIG. 6, of reed block openings 90 and 92. Throttle bore 128 has a diameter 130. Reed block openings 90 and 92 are horizontally spaced by a gap 132 having a width less than diameter 130 of throttle bore 128. The top 134 of throttle bore 128 is horizontally aligned with top end 110 of reed block opening 92. The bottom 136 of throttle bore 128 is horizontally aligned with the bottom end 108 of reed block opening 90. Fuel flows along a travel path from throttle bore 128 through manifold 82 generally horizontally to portions 96 and 98 of reed block openings 90 and 92, respectively. The fuel travels generally vertically in manifold 82 to reed block opening 94.

In one embodiment, manifold 82 includes a deflector plate 138, FIGS. 8 and 9, blocking part of the fuel travel path from throttle bore 128 to reed block opening 90. Manifold 82 has an opening 140. Fuel delivery device 84 is mounted to manifold 82 such that throttle bore 128 is aligned with opening 140. Deflector plate 138 extends across a portion of aligned throttle bore 128 and opening 140 and is horizontally aligned with portion 96 of reed block opening 90. Fuel from device 84 strikes deflector plate 138 and disperses rather than directly entering lower portion 96 of reed block opening 90, to prevent an overly rich fuel mixture in upper cylinder 22 during running of the engine at speeds above idle.

Manifold 82 includes a dam 142, FIG. 10, effective at engine idle and diverting to upper cylinder 22 a portion of the gravitationally induced vertical fuel flow which would otherwise drain to lower cylinder 26 during engine idle and cause an overly rich fuel mixture in lower cylinder 26 and an overly lean fuel mixture in upper cylinder 22. Fuel delivery device 84 is mounted to manifold 82 at opening 140 in the manifold horizontally spaced from portions 96 and 98 of reed block openings 90 and 92. Dam 142 is a ramp extending from manifold opening 140 to portion 96 of reed block opening 90 such that fuel from throttle bore 128 of device 84 drains along ramp 142 to portion 96 of reed block opening 90 during engine idle.

Manifold 82 has an outer wall 144, FIGS. 8 and 9, extending downwardly from manifold opening 140. Another dam is provided by a second ramp 146, FIG. 10, extending from outer wall 144 to the bottom end 112 of reed block opening 92, and providing a fuel drain path to reed block opening 92. Outer wall 144 of manifold 82 has a bulged portion 148, FIGS. 9 and 12, bulged outwardly away from and below manifold opening 140 and generally opposite reed block opening 92 to provide increased air volume. Outer wall 144 has a tapered portion 150 tapered downwardly and inwardly from bulged portion 148 and generally opposite reed block opening 94 and providing decreasing air volume. Manifold 82 has a second opening 152, FIG. 9, above opening 140 and generally opposite reed block opening 90. Opening 152 has a fitting 154 for receiving recirculated heavy fuel ends.

Opening 140 in outer wall 144 of manifold 82 is thus opposite and horizontally aligned with portions 96 and 98 of reed block openings 90 and 92. Fuel delivery device 84 is mounted to manifold 82 and has its throttle bore 128 aligned with opening 140 in outer wall 144 of manifold 82. Reed block opening 90 provides fuel to upper cylinder 22. Reed block opening 92 provides fuel to middle cylinder 24. Each of reed block openings 90 and 92 has upper and lower portions. The lower portion 96 of reed block opening 90 is horizontally aligned with upper portion 98 of reed block opening 92. Manifold 82 includes deflector plate 138 blocking a portion of the fuel flow path from throttle bore 128 of device 84 to lower portion 96 of reed block opening 90, such that at engine speeds above idle, fuel from device 84 strikes deflector plate 138 and disperses rather than directly entering lower portion 96 of reed block opening 90, to prevent an overly rich fuel mixture in upper cylinder 22 during running of the engine at speeds above idle. Deflector plate 138 is part of outer wall 144 of manifold 82 and extends across a portion of opening 140 in outer wall 144.

First, second and third reed blocks 152, 154, 156, FIG. 15, are mounted to a reed block adaptor 158, which is mounted between crankcase 88 and manifold 82. Reed blocks 152, 154, 156 are in respective reed block openings 90, 92, 94. Reed block adaptor 158 has an outer peripheral flange 160 sandwiched between crankcase 88 and manifold 82. Reed block adaptor 158 has first, second and third adaptor openings 162, 164, 166, at which reed blocks 152, 154, 156, respectively, are mounted to reed block adaptor 158 by screws such as 168. Each of the adaptor openings has a length, as shown at arrow 170, and a width, as shown at arrow 172. Length 170 is greater than width 172. Each of the adaptor openings extends longitudinally vertically along its length between a top end and a bottom end. Adaptor openings 162 and 166 are vertically aligned. Adaptor opening 164 is horizontally offset from adaptor openings 162 and 166.

Reed block adaptor 158 further includes a raised rib 174 extending longitudinally parallel to the longitudinal extent of adaptor opening 164. Raised rib 174 has a length greater than the length of adaptor opening 164. The longitudinal extents of adaptor openings 162 and 166 extend colinearly, and raised rib 174 extends longitudinally parallel to the longitudinal extents of adaptor openings 162 and 166.

In the preferred embodiment, the bottom 136, FIG. 6, of throttle bore 128 is located slightly above or horizontally level with the bottom end 108 of upper reed block opening 90. The middle reed block opening 92 is located as close as possible across gap 132 to reed block opening 90 in parallel relation. The middle reed block opening 92 is located low enough that the top end 110 of reed block opening 92 is even with the top 134 of throttle bore 128. The lower reed block opening 94 is located as high as possible, i.e. as high as the opening into the crankcase will allow. Minimum manifold cross sectional area deviation from the throttle bore area is desirable. Minimum variation in crankcase volume is also desirable.

FIG. 16 shows an alternate embodiment, with crankcase 180, diagonal reed block openings 182, 184, 186, and throttle bore 188.

Present Invention

FIGS. 17-24 illustrate the present invention. Crankcase 202 has a first uppermost reed block opening 204, a second middle reed block opening 206, and a third lowermost reed block opening 208. A single intake manifold 210, FIG. 20, covers all of the reed block openings. A single fuel delivery device 84*a* mounted on manifold 210 at studs 212, 214 services all three cylinders and delivers fuel thereto. Fuel delivery device 84*a* is a carburetor such as 84, FIG. 5, or may alternatively be a throttle body fuel injection device, or the like. The fuel delivery device has a throttle bore 128*a*, comparable to bore 128, FIG. 5, at uppermost reed block opening 204, FIG. 17, and spaced above reed block openings 206 and 208.

Throttle bore 128*a* has a first portion 216 (left half of bore 128*a* in FIG. 17) horizontally aligned with a portion of reed block opening 204. Throttle bore 128*a* has a second portion 218 (right half of bore 128*a* in FIG. 17) horizontally offset from reed block opening 204. The bottom 220 of throttle bore 128*a* is spaced slightly above the bottom 222 of reed block opening 204. The top 224 of throttle bore 128*a* is substantially aligned with the top 226 of reed block opening 204. Fuel from portion 218 of throttle bore 128*a* flows downwardly and then laterally leftwardly, FIG. 17, to reed block openings 206 and 208. A flow divider dam 228 in manifold 210 is below reed block opening 204 and throttle bore portion 216. Dam 228 divides the flow from throttle bore 128*a* and diverts to the upper cylinder a portion of the gravitationally induced vertical fuel flow which would otherwise drain to the lower cylinder during engine idle and cause an overly rich fuel mixture in the lower cylinder and an overly lean fuel mixture in the upper cylinder. Reed block opening 204 has a horizontally extending width 230. Flow divider dam 228 has a horizontally extending width substantially the same as width 230 of reed block opening 204 and extending substantially thereacross. A second flow divider dam 232 in manifold 210 is below reed block opening 206 and above reed block opening 208. Dam 232 diverts to the middle cylinder a portion of the gravitationally induced vertical fuel flow which would otherwise drain to the lower cylinder during engine idle and cause an overly rich mixture in the lower cylinder and an overly lean mixture in the middle cylinder. Flow divider dam 232 is vertically in-line with flow divider dam 228.

Cylinders 22, 24, 26 have center-line axes extending horizontally and parallel to each other and lying in a vertical center-line plane 234 (extending into and out of the page in FIG. 18). Reed block openings 204, 206, 208 have faces 236, 238, 240, respectively, lying in a common vertical plane 242 (which lies in the plane of the page in FIG. 18, and which extends into and out of the page in FIGS. 22 and 23). Vertical plane 242 is perpendicular to vertical plane 234. Manifold 210 includes a plenum 244 horizontally offset rightwardly in FIG. 17 from reed block openings 204, 206, 208 along a direction lying in plane 242. Throttle bore 128*a* supplies fuel to plenum 244 such that fuel from the throttle bore flows downwardly in the plenum and then laterally along plane 242 to reed block openings 206 and 208. Fuel flows horizontally through throttle bore 128*a* (into the page in FIG. 17) through portion 218 horizontally aligned with plenum 244, and through portion 216 horizontally aligned with uppermost reed block opening 204. Reed block openings 204, 206, 208 are vertically in-line with each other. The reed block openings are horizontally offset from center-line plane 234 along a direction (leftwardly in FIGS. 17 and 18) extending perpendicularly to plane 234. Plenum 244 of manifold 210 is horizontally between plane 234 and reed block openings 204, 206, 208.

Reed blocks 246,, 248, 250, FIG. 24, are mounted to a reed block adaptor plate 252 by bolts such as 254, and the reed block adaptor plate is mounted between the crankcase and the manifold by the manifold bolts such as 256, with reed blocks 246, 248, 250 in respective reed block openings 204, 206, 208. Manifold 210 and adaptor plate 252 define plenum 244 therebetween with a front wall at the manifold and a back wall at the adaptor plate.

It is recognized that various equivalents, alternatives and modifications are possible within the scope of the appended claims.

We claim:

1. A two cycle internal combustion engine comprising three cylinders vertically in-line, a crankcase having a first uppermost reed block opening, a second middle reed block opening, and a third lowermost reed block opening, a single intake manifold covering all of said reed block openings, a single fuel delivery device on said manifold and having a throttle bore at said first reed block opening and spaced above said second and third reed block openings.

2. The invention according to claim 1 wherein said throttle bore has a first portion horizontally aligned with a portion of said first reed block opening and a second portion horizontally offset from said first reed block opening.

3. The invention according to claim 2 wherein the bottom of said throttle bore is spaced slightly above the bottom of said first reed block opening.

4. The invention according to claim 2 wherein said cylinders have center-line axes extending horizontally and parallel to each other and lying in a vertical center-line plane, and wherein fuel from said second portion of said throttle bore flows downwardly and then laterally to said second and third reed block openings along a direction perpendicular to said center-line plane.

5. The invention according to claim 2 comprising a flow divider dam in said manifold below said first reed block opening and said first portion of said throttle bore and dividing the flow from said throttle bore and diverting to the upper cylinder a portion of the gravitationally induced vertical fuel flow which would otherwise drain to the lower cylinder during engine idle and cause an overly rich fuel mixture in the lower cylinder and an overly lean fuel mixture in the upper cylinder.

6. The invention according to claim 5 wherein said first reed block opening has a horizontally extending width, and said flow divider dam has a horizontally extending width substantially the same as said width of said first reed block opening and extending substantially thereacross.

7. The invention according to claim 5 comprising a second flow divider dam in said manifold below said second reed block opening and above said third reed block opening and diverting to the middle cylinder a portion of the gravitationally induced vertical fuel flow which would otherwise drain to the lower cylinder during engine idle and cause an overly rich mixture in the lower cylinder and an overly lean mixture in the middle cylinder.

8. The invention according to claim 7 wherein said second flow divider dam is vertically in-line with said first mentioned flow divider dam.

9. A two cycle internal combustion engine comprising three cylinders vertically in-line, a crankcase having first, second and third reed block openings having faces lying in a common place, a single intake manifold covering all of said reed block openings and including a plenum horizontally offset from said reed block openings along a direction lying in said common plane, a single fuel delivery device on said manifold and having a throttle bore supplying fuel to said plenum such that fuel from said throttle bore flows downwardly in said plenum and then laterally along said common plane to said second and third reed block openings.

10. The invention according to claim 9 comprising a flow divider dam in said manifold vertically in-line with and below the uppermost reed block opening.

11. The invention according to claim 10 wherein said flow divider dam is also vertically in-line with and below said throttle bore.

12. The invention according to claim 11 wherein said throttle bore has a first portion vertically in-line with and above said flow divider dam and horizontally aligned with said uppermost reed block opening, and wherein said throttle bore has a second portion horizontally aligned with said plenum.

13. The invention according to claim 9 wherein the bottom of said throttle bore is spaced slightly above the bottom of the uppermost reed block opening.

14. The invention according to claim 9 wherein the top of said throttle bore is substantially horizontally aligned with the top of the uppermost reed block opening.

15. A two cycle internal combustion engine comprising three cylinders vertically in-line with each other, a crankcase having three reed block openings vertically in-line with each other, a single manifold servicing all three of said cylinders and covering all three of said reed block openings, a single fuel delivery device on said manifold delivering fuel to each of said cylinders through a respective block opening.

16. The invention according to claim 15 wherein said manifold has a plenum portion horizontally between said vertical center-line plane and said reed block openings.

17. The invention according to claim 16 wherein said fuel delivery device has a throttle bore with a first portion horizontally aligned with a portion of one of said reed block openings, and a second portion horizontally aligned with a portion of said plenum.

18. A two cycle internal combustion engine comprising three cylinders vertically in-line, a crankcase having first, second and third reed block openings, one for each of said cylinders, a reed block adaptor plate, first, second and third reed blocks mounted to said reed block adaptor plate, a single intake manifold mounted to said crankcase and covering all of said reed block openings, said reed block adaptor plate being mounted between said crankcase and said manifold, with said first, second and third reed blocks in said first, second and third reed block openings, respectively, said manifold and said reed block adaptor plate defining a plenum therebetween with a front wall at said manifold and a back wall at said reed block adaptor plate, which plenum is laterally offset from said reed block openings, a single fuel delivery device on said manifold delivering fuel to each of said cylinders.

19. The invention according to claim 18 wherein said reed block openings are vertically in-line with each other, and wherein said cylinders have respective center-line axes extending horizontally and parallel to each other and lying in a vertical center-line plane, and wherein said plenum between said manifold and said reed block adaptor plate is laterally offset from said reed block openings along a direction perpendicular to said center-line plane.

* * * * *

UNITED STATES PATENT AND TRADEMARK OFFICE

CERTIFICATE OF CORRECTION

PATENT NO. : 5,119,771

DATED : June 9, 1992

INVENTOR(S) : RICHARD A. DAVIS ET AL

It is certified that error appears in the above-identified patent and that said Letters Patent is hereby corrected as shown below:

CLAIM 15, Col. 8, Line 12, after "opening" and before the period, insert -- , wherein said cylinders have center-line axes extending horizontally and parallel to each other and lying in a vertical center-line plane, and wherein said reed block openings are horizontally offset from said vertical center-line plane --.

Signed and Sealed this

Tenth Day of August, 1993

*Attest:*

Michael K. Kirk

MICHAEL K. KIRK

*Attesting Officer*

*Acting Commissioner of Patents and Trademarks*